US008777371B2

(12) United States Patent
Kasahara et al.

(10) Patent No.: US 8,777,371 B2
(45) Date of Patent: Jul. 15, 2014

(54) MAINTENANCE DEVICE AND LIQUID EJECTING APPARATUS

(71) Applicant: Seiko Epson Corporation, Tokyo (JP)

(72) Inventors: Nagatoshi Kasahara, Matsumoto (JP); Shinichi Tsubota, Azumino (JP); Masashi Kamibayashi, Matsumoto (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/828,253

(22) Filed: Mar. 14, 2013

(65) Prior Publication Data

US 2013/0249998 A1 Sep. 26, 2013

(30) Foreign Application Priority Data

Mar. 22, 2012 (JP) ..... 2012-065875

(51) Int. Cl.
*B41J 2/165* (2006.01)

(52) U.S. Cl.
USPC ..... 347/31

(58) Field of Classification Search
CPC ..... B41J 2/16535
USPC ..... 347/31, 33
See application file for complete search history.

(56) References Cited

U.S. PATENT DOCUMENTS

| | | | | |
|---|---|---|---|---|
| 4,571,601 A * | 2/1986 | Teshima | ..... | 347/33 |
| 7,731,328 B2 * | 6/2010 | Jung et al. | ..... | 347/33 |
| 2010/0245466 A1 * | 9/2010 | Inoue | ..... | 347/30 |

FOREIGN PATENT DOCUMENTS

| | | | | |
|---|---|---|---|---|
| JP | 11-078034 | | 3/1999 | |
| JP | 2000-163721 | * | 6/2000 | ..... G11B 5/41 |
| JP | 2005-212351 | | 8/2005 | |

* cited by examiner

*Primary Examiner* — Alessandro Amari
*Assistant Examiner* — Michael Konczal
(74) *Attorney, Agent, or Firm* — Workman Nydegger

(57) ABSTRACT

A maintenance device includes a liquid absorption body which absorbs a liquid which is attached to a nozzle forming surface by abutting the nozzle forming surface of a liquid ejecting head in which a plurality of nozzle rows configured of a plurality of nozzles ejecting the liquid are provided in parallel, wherein the liquid absorption body has a penetration suppressing section which suppresses the spread of the liquid due to penetration of the liquid absorbed from the nozzle forming surface of the liquid ejecting head, and wherein the penetration suppressing section is disposed between the nozzle rows ejecting the liquids of different colors from each other in a direction intersecting the nozzle row direction, in a case where the liquid absorption body abuts the nozzle forming surface of the liquid ejecting head.

7 Claims, 12 Drawing Sheets

MAINTENANCE DEVICE AND LIQUID EJECTING APPARATUS

BACKGROUND

1. Technical Field

The present invention relates to a maintenance device performing maintenance of a liquid ejecting head and a liquid ejecting apparatus including the maintenance device.

2. Related Art

In the related art, as a type of a liquid ejecting apparatus, an ink jet type printer which forms an image by ejecting a liquid from a liquid ejecting head on a medium such as a paper has been known. In such a printer, a maintenance device is usually provided in order to maintain characteristics in ejecting the liquid from the liquid ejecting head.

For example, a printer disclosed in JP-A-2005-212351 has an ink wiping device as such a maintenance device which wipes ink (liquid) attached to a recording head (a liquid ejecting head). The ink wiping device has a feeding shaft on which a long-shaped ink absorption body (a liquid absorption body) is wound in a roll shape and a winding shaft which winds the ink absorption body which is unwound from the feeding shaft. Then, the printer is configured such that a portion of the ink absorption body, which is hung between the feeding shaft and the winding shaft, is pressed on a nozzle forming surface of the recording head by a pressing member and then closely comes into contact with the nozzle forming surface. As a result, the ink attached to the nozzle forming surface of the recording head is absorbed by the ink absorption body and is removed.

However, in the printer described above, when the ink does not evenly attached to the entire nozzle forming surface of the recording head, a region, in which the ink attached to the nozzle forming surface of the recording head is not absorbed, occurs in a portion of the ink absorption body which closely comes into contact with the nozzle forming surface of the recording head. Therefore, it is also conceivable that the portion of the ink absorption body once coming into contact with the nozzle forming surface of the recording head repeatedly comes into close contact with the nozzle forming surface of the recording head so as to effectively use the region in which ink is not absorbed in the ink absorption body.

However, in this case, the ink absorption body may repeatedly come into close contact with the nozzle forming surface of the recording head in a state where the ink absorbed in the ink absorption body penetrates and spreads. As a result, on the nozzle forming surface of the recording head, since the ink is transferred from the ink absorption body to the nozzle row including the nozzles ejecting color ink different from the ink which is absorbed in the ink absorption body, there is a concern that color mixing of the ink may occur in nozzles including the nozzle row.

SUMMARY

An advantage of some aspects of the invention is to provide a maintenance device in which occurrence of color mixing of the liquid inside the nozzles of a liquid ejecting head is suppressed while effectively using a liquid absorption body, and a liquid ejecting apparatus.

According to an aspect of the invention, there is provided a maintenance device including: a liquid absorption body which absorbs a liquid which is attached to a nozzle forming surface by abutting the nozzle forming surface of a liquid ejecting head in which a plurality of nozzle rows configured of a plurality of nozzles ejecting the liquid are provided in parallel, wherein the liquid absorption body has a penetration suppressing section which suppresses the penetration and spread of the liquid absorbed from the nozzle forming surface of the liquid ejecting head, and wherein the penetration suppressing section is disposed between the nozzle rows ejecting the liquids of different colors from each other in a direction intersecting the nozzle row direction in a case where the liquid absorption body abuts the nozzle forming surface of the liquid ejecting head.

According to the maintenance device of the aspect of the invention, that the liquid absorbed in the liquid absorption body from the nozzle rows ejecting the liquids of different colors from each other penetrates and spreads in the direction intersecting the nozzle row direction is suppressed by the penetration suppressing section. Thus, even though the liquid absorption body repeatedly abuts the nozzle forming surface of the recording head, it is suppressed that the liquid absorbed in the liquid absorption body is transferred to an adjacent nozzle row ejecting the liquid of a color different from the above liquid. Accordingly, the occurrence of color mixing of the liquid inside the nozzles of the liquid ejecting head can be suppressed while efficiently using the liquid absorption body.

Furthermore, in the maintenance device of the invention, the penetration suppressing section may be provided so as to extend along the nozzle row direction.

According to the maintenance device of the aspect of the invention, the portion of the liquid absorption body which receives the liquids of different colors from each other from the adjacent nozzle rows is separated by the penetration suppressing section in the direction intersecting the nozzle row direction. Thus, it is more reliably suppressed that the liquid absorbed in the liquid absorption body is transferred to the nozzle row including nozzles ejecting the liquids of different colors from the above liquid.

Furthermore, in the maintenance device of the invention, the liquid absorption body may wipe the nozzle forming surface by moving in the nozzle row direction in a state of abutting the nozzle forming surface of the liquid ejecting head.

According to the maintenance device of the aspect of the invention, when the liquid absorption body wipes the nozzle forming surface of the liquid ejecting head, a receiving portion of the liquid is formed in the liquid absorption body so as to spread in the nozzle row direction of the liquid ejecting head. Thus, even though the liquid absorption body moves in the direction of wiping the nozzle forming surface of the liquid ejecting head, a state where the penetration suppressing section is interposed between the portions of the liquid absorption body, which receive the liquids of different colors from each other from the adjacent nozzle rows is maintained. Accordingly, it can be suppressed that color mixing of the liquid inside the nozzles of the liquid ejecting head occurs while efficiently absorbing the liquid attached to the nozzle forming surface of the liquid ejecting head.

Furthermore, in the maintenance device of the invention, the penetration suppressing section may be a through hole formed on the liquid absorption body.

According to the maintenance device of the aspect of the invention, a configuration can be easily realized, in which penetration and spread of the liquid absorbed in the liquid absorption body is suppressed.

According to another aspect of the invention, there is provided a liquid ejecting apparatus including: a plurality of liquid ejecting heads in which a plurality of nozzle rows configured of a plurality of nozzles are provided in parallel; and the maintenance device having the configuration.

According to the maintenance device of the aspect of the invention, the same advantage as the maintenance device described above is obtained.

BRIEF DESCRIPTION OF THE DRAWINGS

The invention will be described with reference to the accompanying drawings, wherein like numbers reference like elements.

FIG. 5A is a schematic view illustrating a state where the wiping member wipes the nozzle forming surface of the recording head in a forward direction, FIG. 5B is a schematic view illustrating a state where the wiping member crosses the nozzle forming surface of the recording head in a forward direction from the state illustrated in FIG. 5A, FIG. 5C is a schematic view illustrating a state where the wiping member wipes the nozzle forming surface of the recording head in a backward direction from the state illustrated in FIG. 5B and FIG. 5D is a schematic view illustrating a state where the wiping member crosses the nozzle forming surface of the recording head in the backward direction from the state of being illustrated in FIG. 5C.

FIG. 11A is a schematic view illustrating a state where the wiping member abuts the nozzle forming surface of the recording head, FIG. 11B is a schematic view illustrating a state where the wiping member is separated from the nozzle forming surface of the recording head from the state illustrated in FIG. 11A and FIG. 11C is a schematic view illustrating a state where the wiping member abuts the nozzle forming surface of the recording head from the state illustrated in FIG. 11B.

FIG. 14A is a schematic view illustrating a state where the wiping member abuts the nozzle forming surface of the recording head and FIG. 14B is a schematic view illustrating a state where a pressing roller is moved from a state illustrated in FIG. 14A.

DESCRIPTION OF EXEMPLARY EMBODIMENTS

First Embodiment

Hereinafter, a first embodiment in which the invention is embodied in an ink jet type printer that is a type of a liquid ejecting apparatus and in a maintenance device which is included in the printer will be described according to FIGS. 1 to 6.

Figure 1:
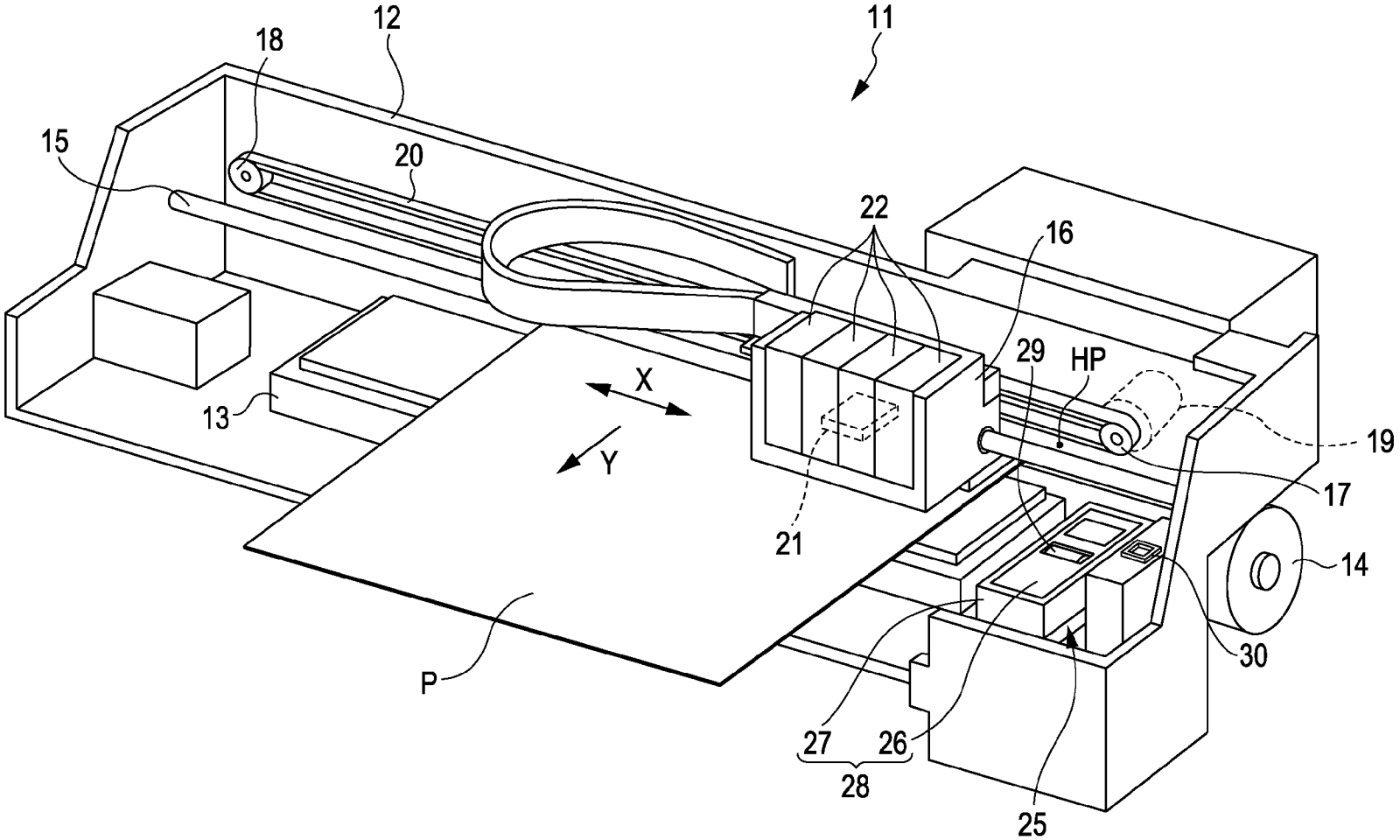
FIG. 1 is a perspective view of a printer of a first embodiment according to the invention.

As illustrated in FIG. 1, a substantially rectangular board-shaped support member 13 is provided in a state where the longitudinal direction thereof corresponds with a main scanning direction X at a lower portion inside a substantially rectangular box-shaped frame 12 in a printer 11. A paper P is fed in a sub-scanning direction Y orthogonal to a main scanning direction X on the support member 13, based on a driving of a paper feeding motor 14 provided in the lower portion of a rear surface of the frame 12. In addition, a rod-shaped guide shaft 15 extending parallel to the support member 13 in the longitudinal direction is provided above the support member 13 inside the frame 12. The guide shaft 15 supports a carriage 16 in a state where reciprocating movement may be performed in the axial direction thereof.

A driving pulley 17 and a driven pulley 18 are rotatably supported at each position corresponding to both end portions of the guide shaft 15 in the inner surface of a wall portion on a rear side of the frame 12. The driving pulley 17 is connected to an output shaft of a carriage motor 19 which is a driving source when the carriage 16 reciprocates. In addition, an endless type timing belt 20 of which a portion is connected to the carriage 16 is hung between a pair of pulleys 17 and 18. Accordingly, the carriage 16 is capable of moving in the main scanning direction X via the endless type timing belt 20 by the driving force of the carriage motor 19 while being guided by the guide shaft 15.

Figure 4:
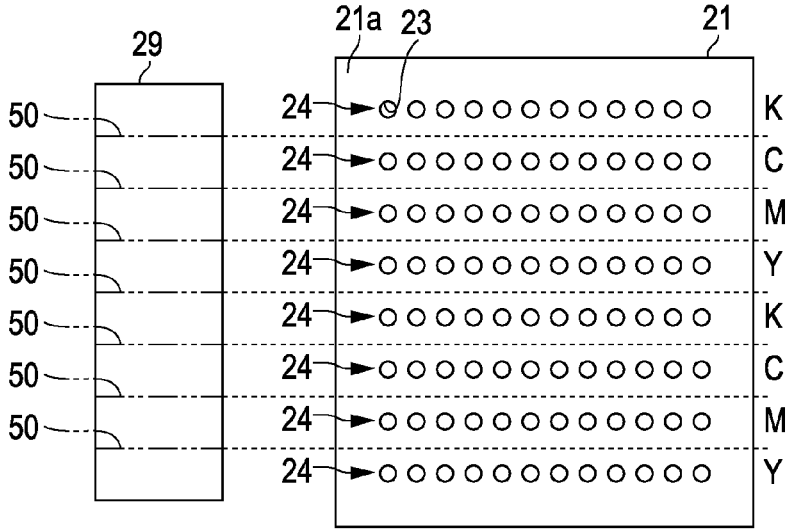
FIG. 4 is a schematic view illustrating a positional relationship between a wiping member and a nozzle row of a recording head in the printer of the same embodiment.

A recording head 21 is provided on the lower surface of the carriage 16 as a liquid ejecting head and a plurality of (four in the embodiment) ink cartridges 22 storing the ink (liquid) which is supplied to the recording head 21 are detachably equipped on the carriage 16. In addition, as illustrated in FIG. 4, a plurality of nozzle rows 24 configured of nozzles 23 ejecting the ink of each color (cyan (C), magenta (M), yellow (Y) and black (K) in the embodiment) are provided in a nozzle forming surface 21*a* which is a lower surface of the recording head 21. The nozzle rows 24 are provided in parallel in a direction orthogonal to the main scanning direction X of the carriage 16. Then, the recording is performed on the paper P by ejecting ink droplets on the paper P which is fed on the support member 13 from the nozzles 23 formed on the nozzle forming surface 21*a* of the recording head 21.

In addition, as illustrated in FIG. 1, a maintenance device 25 for performing maintenance of the recording head 21 is provided in a home position HP which is provided in a position deviated from a recording region to which the paper P is transported inside the frame 12.

The maintenance device 25 includes a wiper cassette 26, a wiper holder 27 in which the wiper cassette 26 is detachably installed and a wiper unit 28 having a driving mechanism (not illustrated) driving the wiper holder 27 in the nozzle row direction of the recording head 21. The wiper cassette 26 has a wiping member 29 as a liquid absorption body absorbing the ink which is attached to the nozzle forming surface 21*a* by abutting the nozzle forming surface 21*a* of the recording head 21. In addition, the maintenance device 25 includes a cap 30 abutting the nozzles 23 so as to surround the nozzle forming surface 21*a* and a pump (not illustrated) which is driven to suck and discharge a waste ink from the nozzles 23 of the recording head 21 through the cap 30.

Next, a configuration of the wiper cassette 26 will be described.

Figure 2:
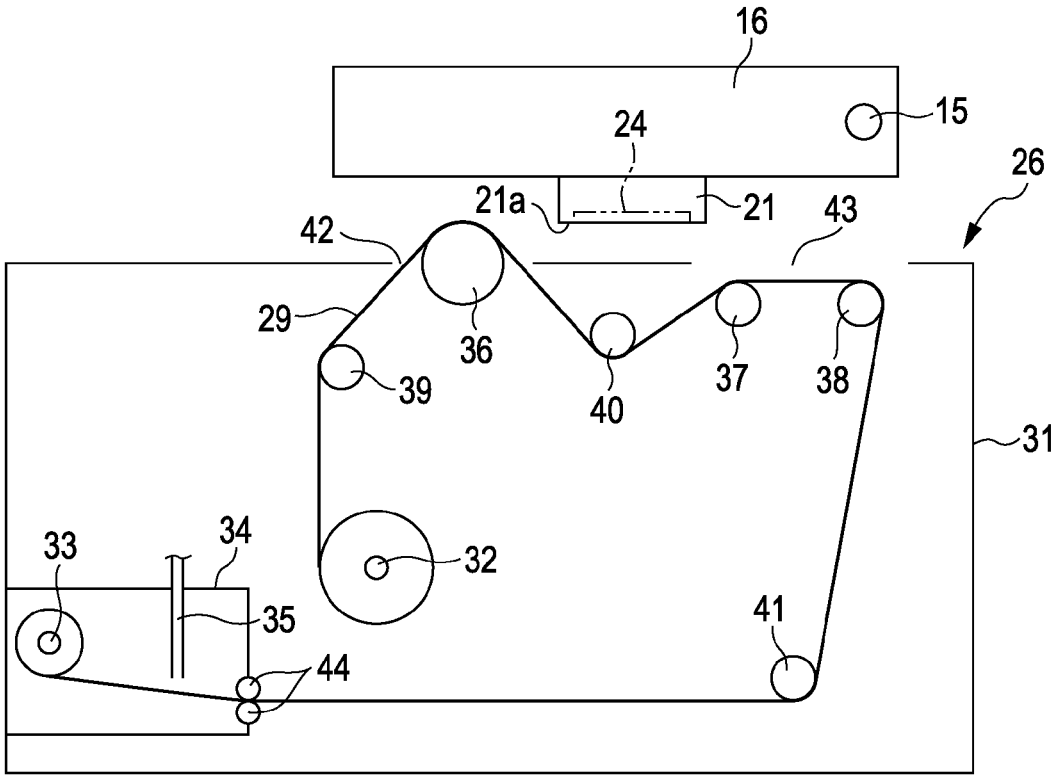
FIG. 2 is a schematic view illustrating an internal configuration of a wiper cassette in the printer of the same embodiment.

As illustrated in FIG. 2, a pair of rollers 32 and 33 having an axis expanding horizontally in a direction orthogonal to the moving direction of the wiper cassette 26 are accommodated in a case body 31 having a substantially box shape configuring an exterior of the wiper cassette 26. The elongated wiping member 29 having a width dimension corresponding to all region of the formation region of the nozzles 23 in the nozzle forming surface 21*a* of the recording head 21 is hung between the pair of rollers 32 and 33. One of the pair of rollers 32 and 33 functions as the reel-out roller 32 which reels out the unused wiping member 29 which is wound. In addition, the other roller of the pair of rollers 32 and 33 functions as the winding roller 33 which winds the used wiping member 29 which is released from the reel-out roller 32 and used for wiping.

In addition, the winding roller 33 is accommodated inside a waste-ink tank 34 detachably provided in the case body 31. The waste-ink tank 34 receives the waste ink discharged from the cap 30 through a discharge tube 35. Then, both ends of the winding roller 33 in the axial direction are rotatably supported by a bearing portion or the like provided in side wall portion of the waste-ink tank 34.

In addition, a plurality of (six in the embodiment) rollers 36 to 41 are provided on a reel-out path of the wiping member 29 from the reel-out roller 32 to the waste-ink tank 34 inside the case body 31. The rollers 36 to 41 are extended in parallel with the reel-out roller 32 and the winding roller 33, and both ends thereof in the axial direction are rotatably supported by a bearing portion or the like provided in the side wall portion of the case body 31.

In particular, a portion of the wiping member 29 which is reeled out from the reel-out roller 32 is wound and hung on the pressing roller 36 obliquely provided above the reel-out roller 32. Both ends of the pressing roller 36 in the axial direction are biased vertically upwards by a biasing spring (not illustrated). Then, the pressing roller 36 protrudes upwards from the upper surface of the case body 31 through a rectangular-shaped opening section 42 (see, FIG. 3) formed on the upper surface of the case body 31. Thus, a portion of the wiping member 29 which is wound and hung on the pressing roller 36 protrudes upwards from the upper surface of the case body 31. In addition, the uppermost portion of the circumferential surface of the pressing roller 36 is positioned above the nozzle forming surface 21*a* of the recording head 21.

In addition, a pair of support rollers 37 and 38 are provided in positions adjacent to the pressing roller 36 in the moving direction of the wiper cassette 26. The pair of rollers 37 and 38 are provided to have substantially the same height as each other at a distance in the moving direction of the wiper cassette 26. Then, a portion of the wiping member 29, which is hung between the support rollers 37 and 38 so as to be extended in the horizontal direction, is exposed to the outside of the case body 31 through a rectangular-shaped opening section 43 (see, FIG. 3) formed on the upper surface of the case body 31. In addition, the opening section 43 of the case body 31 exposes the entire region of the wiping member 29 in a width direction orthogonal to a reel-out direction to the outside of the case body 31.

In addition, tension rollers 39 and 40 applying the tension to the wiping member 29 are provided between the reel-out roller 32 and the pressing roller 36, and between the pressing roller 36 and the support roller 37 in the reel-out path of the wiping member 29.

In addition, the wiping member 29, which is reeled out from the support roller 38, is reeled out toward the waste-ink tank 34 via the relay roller 41 provided vertically below the support roller 38. Then, the wiping member 29 is inserted into the waste-ink tank 34 via a roller pair 44 rotatably provided on the outer surface of the waste-ink tank 34, and is wound by the winding roller 33 accommodated in the waste-ink tank 34. In this case, the portion of the wiping member 29 which is inserted into the waste-ink tank 34 is disposed so as to face a discharge port of the discharge tube 35 in the vertical direction. Thus, the waste ink discharged from the cap 30 through the discharge tube 35 is received by the wiping member 29.

Figure 3:
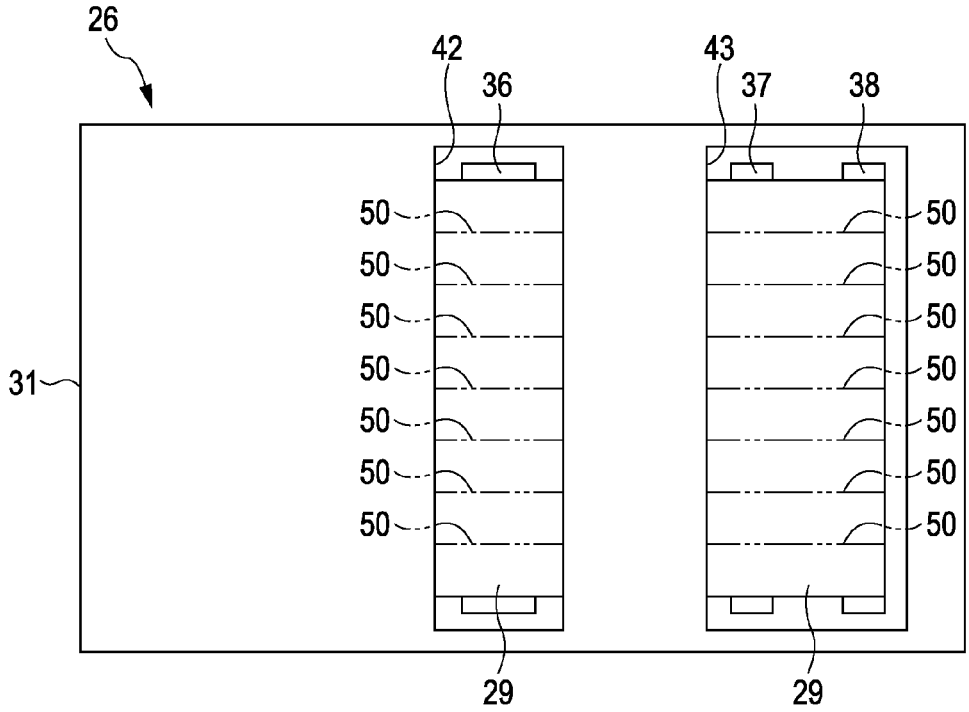
FIG. 3 is a plan view of the wiper cassette in the printer of the same embodiment.

In addition, as illustrated in FIGS. 3 and 4, as through holes illustrated in two-dot chain lines, the entire region of the wiping member 29 in the longitudinal direction has perforations 50 formed so as to extend along the reel-out direction of the wiping member 29 which is the nozzle row direction of the recording head 21. The perforations 50 are disposed in the same interval in the width direction orthogonal to the reel-out direction of the wiping member 29. The interval of the perforations 50 is substantially the same as the interval between the nozzle rows 24 adjacent to each other formed in the nozzle forming surface 21*a* of the recording head 21. Then, when the wiping member 29 abuts the nozzle forming surface 21*a* of the recording head 21, each of the perforations 50 is disposed between the adjacent nozzle rows 24 ejecting different color inks from each other in the direction orthogonal to the nozzle row direction of the recording head 21.

Next, operations of the printer 11 configured as described above will be described.

First, when wiping member 29 wipes the ink from the nozzle forming surface 21*a* of the recording head 21, the carriage 16 is moved to the home position HP. In this case, as illustrated in FIG. 2, in a state where the wiper cassette 26 is disposed in an initial position, the recording head 21 is disposed having a distance with respect to the pressing roller 36 in a direction orthogonal to the moving direction of the carriage 16.

Figure 5A:
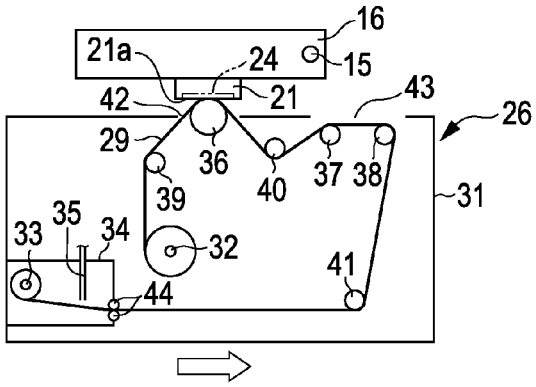
FIGS. 5A to 5D are schematic views illustrating operations when the wiping member removes ink from a nozzle forming surface of the recording head.

Next, as illustrated in FIG. 5A, the wiper cassette 26 is moved toward the recording head 21 in the forward direction orthogonal to the moving direction of the carriage 16 according to the driving of the driving mechanism. Then, a portion of the wiping member 29 which is wound and hung on the pressing roller 36 comes into sliding contact with the recording head 21 according to the movement of the recording head 21 toward the forward direction with respect to the nozzle forming surface 21*a* of the recording head 21. Accordingly, the ink is wiped from the nozzle forming surface 21*a*. In this case, the wiping member 29 moves in the nozzle row direction of the recording head 21 in a state of being abutted by the nozzle forming surface 21*a* of the recording head. Accordingly, the nozzle forming surface 21*a* is wiped. Then, the ink which is wiped from the nozzle forming surface 21*a* of the recording head 21 is absorbed by the wiping member 29.

Figure 5B:
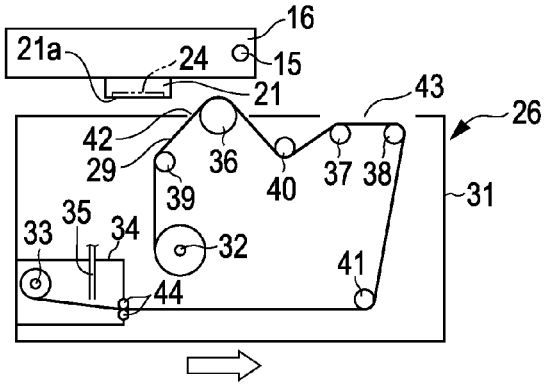

Continuously, as illustrated in FIG. 5B, when the wiper cassette 26 is further moved in the forward direction, a portion of the wiping member 29 which is wound and hung on the pressing roller 36 crosses the nozzle forming surface 21*a* of the recording head 21. As a result, the entire region of the nozzle forming surface 21*a* of the recording head 21 is wiped by the wiping member 29.

Figure 6:
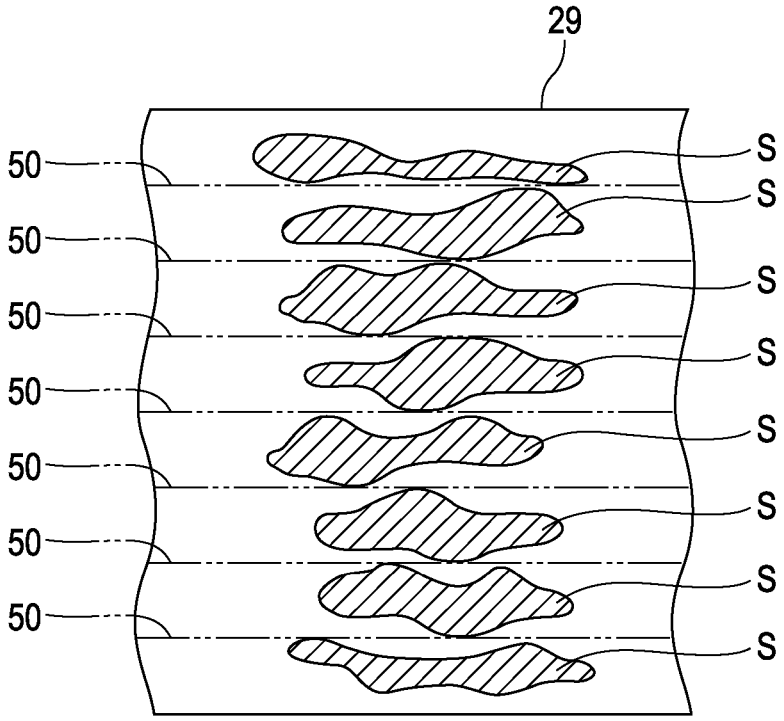
FIG. 6 is a schematic view of the wiping member in which an absorption region of the ink is formed.

In this case, as illustrated in FIG. 6, an ink absorption region S, in which each color ink corresponding to each of the nozzle rows 24 of the recording head 21 spreads in the nozzle row direction of the recording head 21 which is the moving direction of the wiper cassette 26, is formed on the wiping member 29. Then, the absorption region S of each color ink in the wiping member 29 is separated by the perforations 50 of the wiping member 29 in the width direction orthogonal to the reel-out direction of the wiping member 29. As a result, the ink forming the absorption region S penetrates the wiping member 29 in the width direction so as to come close to an adjacent absorption region S, however, this is interrupted by the perforations 50 formed on the wiping member 29. At this point, in the embodiment, the perforations 50 of the wiping member 29 functions as a penetration suppressing section to suppress that the ink absorbed from the nozzle forming surface 21*a* of the recording head 21 penetrates and spreads to the wiping member 29.

Then, it is suppressed that the absorption region S of each color ink formed on the wiping member 29 spreads and is overlapped with each other in the width direction of the wiping member 29. Accordingly, it is suppressed that the inks absorbed in the wiping member 29 are mixed with each other. Thus, even though the portion of the wiping member 29, in which the ink is once wiped, abuts the nozzle forming surface 21*a* of the recording head 21, the absorption region S of the ink in the wiping member 29 comes into contact with the nozzle rows 24 each ejecting a corresponding color ink. Accordingly, even though the wiping member 29 wipes repeatedly the nozzle forming surface 21*a* of the recording head 21, it is suppressed that color mixing of the ink occurs in each of the nozzle rows 24 of the recording head 21.

Figure 5C:
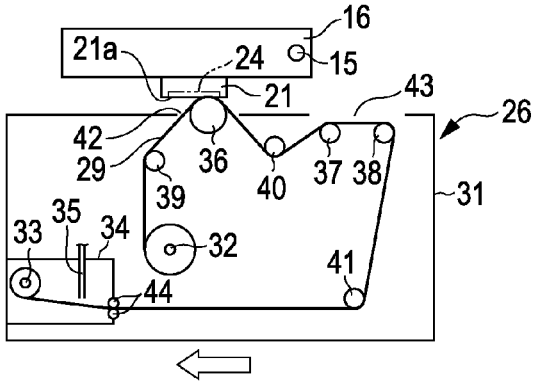

Then, in the embodiment, as illustrated in FIG. 5C, the driving mechanism is driven without winding up the wiping member 29, and accordingly the wiper cassette 26 is moved toward the recording head 21 in the backward direction orthogonal to the moving direction of the carriage 16. Then, a used portion of the wiping member 29 absorbing the ink, which is wound and hung on the pressing roller 36, comes into sliding contact with the recording head 21 according to the movement toward the backward direction with respect to the nozzle forming surface 21*a* of the recording head 21. Then, the ink wiped from the nozzle forming surface 21*a* of the recording head 21 is absorbed by the wiping member 29.

Figure 5D:
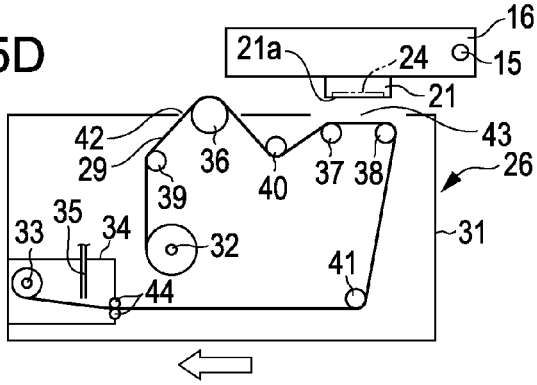

Then, as illustrated in FIG. 5D, when the wiper cassette 26 is further moved in the backward direction, the position of the wiping member 29 which is wound and hung on the pressing roller 36 crosses the nozzle forming surface 21*a* of the recording head 21. As a result, the entire region of the nozzle forming surface 21*a* of the recording head 21 is wiped by the wiping member 29.

In this case, when the wiper cassette 26 moves to a position in which the nozzle forming surface 21*a* of the recording head 21 faces the opening section 43 of the case body 31 in the vertical direction, the movement of the wiper cassette 26 is stopped. Then, in this state, for maintenance of the recording head 21, the ink is idle ejected from the nozzles 23 of the recording head 21 as the flushing operation. Then, the ink ejected from the nozzles 23 enters the case body 31 through the opening section 43, and accordingly, the ink is received in the portion of the wiping member 29 which is hung between the support rollers 37 and 38. In addition, the wiping member 29 receives the ink which is idle ejected from the nozzles of the recording head 21 on the same surface as the surface which is pressed to the nozzle forming surface 21*a* of the recording head 21 by the pressing roller 36.

According to the embodiment described above, advantages can be obtained as described below.

(1) It is suppressed by the perforations 50 that the ink, absorbed in the wiping member 29 from the nozzle rows 24 ejecting inks of different colors from each other, penetrates and spreads in the direction orthogonal to the nozzle row direction. Thus, even though the wiping member 29 repeatedly abuts the nozzle forming surface 21*a* of the recording head 21, it is suppressed that the ink absorbed in the wiping member 29 is transferred to the adjacent nozzle rows 24 ejecting the inks of different colors from the above ink. Accordingly, it is suppressed that the color mixing of the ink occurs in the nozzles of the recording head 21 while effectively using the wiping member 29.

(2) The portion of the wiping member 29 which receives inks of different colors from each other from the adjacent nozzle rows 24 is separated by the perforations 50 in the direction orthogonal to the nozzle row direction. Thus, it may be further reliably suppressed that the ink absorbed in the wiping member 29 is transferred to the nozzle rows 24 including the nozzles ejecting inks of different colors from the above ink.

(3) When the wiping member 29 wipes the nozzle forming surface 21*a* of the recording head 21, the absorption region S of the ink is formed on the wiping member 29 so as to spread in the nozzle row direction of the recording head 21. Thus, even though the wiping member 29 moves in the wiping direction of the nozzle forming surface 21*a* of the recording head 21, a state where the perforations 50 are interposed between the portions of the wiping member 29 which receive the inks of different colors from each other from the adjacent nozzle rows 24 is maintained. Accordingly, it can be suppressed that the color mixing of the ink occurs in the nozzles of the recording head 21 while the ink attached to the nozzle forming surface 21*a* of the recording head 21 is effectively absorbed.

(4) A configuration can be easily realized, in which penetration and spread of the ink absorbed in the wiping member 29 is suppressed, by providing the perforations 50 on the wiping member 29.

(5) The wiping member 29 repeatedly wipes the nozzle forming surface 21*a* of the recording head 21 in a state of being wet by including the ink wiped from the nozzle forming surface 21*a* of the recording head 21. Thus, the ink attached to the nozzle forming surface 21*a* of the recording head 21 can be more reliably wiped and removed.

(6) The wiping member 29 wipes repeatedly the nozzle forming surface 21*a* of the recording head 21. Thus, it is possible to reduce the consumption of the wiping member 29 by comparing the case where the used portion of the wiping member 29 is wound whenever wiping the nozzle forming surface 21*a* of the recording head 21. In addition, since the number of windings of the wiping member 29 is reduced, it is possible to improve the throughput of the wiping operation of the wiping member 29 to the nozzle forming surface 21*a* of the recording head 21.

(7) The wiping member 29 receives the ink which is idle ejected from the nozzles 23 of the recording head 21 when the flushing operation is performed. Thus, since it is not required to provide a dedicated member for receiving the ink which is idle ejected from the nozzles of the recording head 21, the number of the parts can be reduced.

(8) The wiping member 29 is reeled out from the reel-out roller 32 toward the winding roller 33 if needed. Thus, the wiping member 29 may suppress that the ink is accumulated on the portion in which the ink idle ejected from the nozzles 23 of the recording head 21 is received.

(9) If the ink absorbed in the carriage 30 from the nozzles of the recording head 21 is discharged in the waste-ink tank 34 through the discharge tube 35 when the cleaning operation is performed, the discharged ink is received by the wiping member 29. Thus, since it is not required to provide a dedicated member for receiving the ink which is discharged in the waste-ink tank 34, the number of the parts can be reduced.

(10) The wiping member 29 is reeled out from the reel-out roller 32 toward the winding roller 33 if needed. Thus, the wiping member 29 may suppress that the ink is accumulated on the portion in which the ink discharged from the inside of the cap 30 through the discharge tube 35 is received.

(11) The used portion of the wiping member 29 is wound and recovered by the winding roller 33 provided in the waste-ink tank 34. Thus, when the waste-ink tank 34 is removed from the wiper cassette 26, the wiping member 29 which is used is taken out from the wiper cassette 26. Accordingly, maintenance and exchange of the wiper cassette 26 can be simply performed.

Second Embodiment

Next, a second embodiment of the invention will be described based on FIGS. 7 to 12. In addition, the configuration of the wiper unit 28 of the second embodiment is different from that of the first embodiment. Accordingly, in the description below, a configuration different from that of the first embodiment will be mainly described and the same reference numeral will be given to the same configuration in the first embodiment, and repeated description thereof will be omitted.

Figure 7:
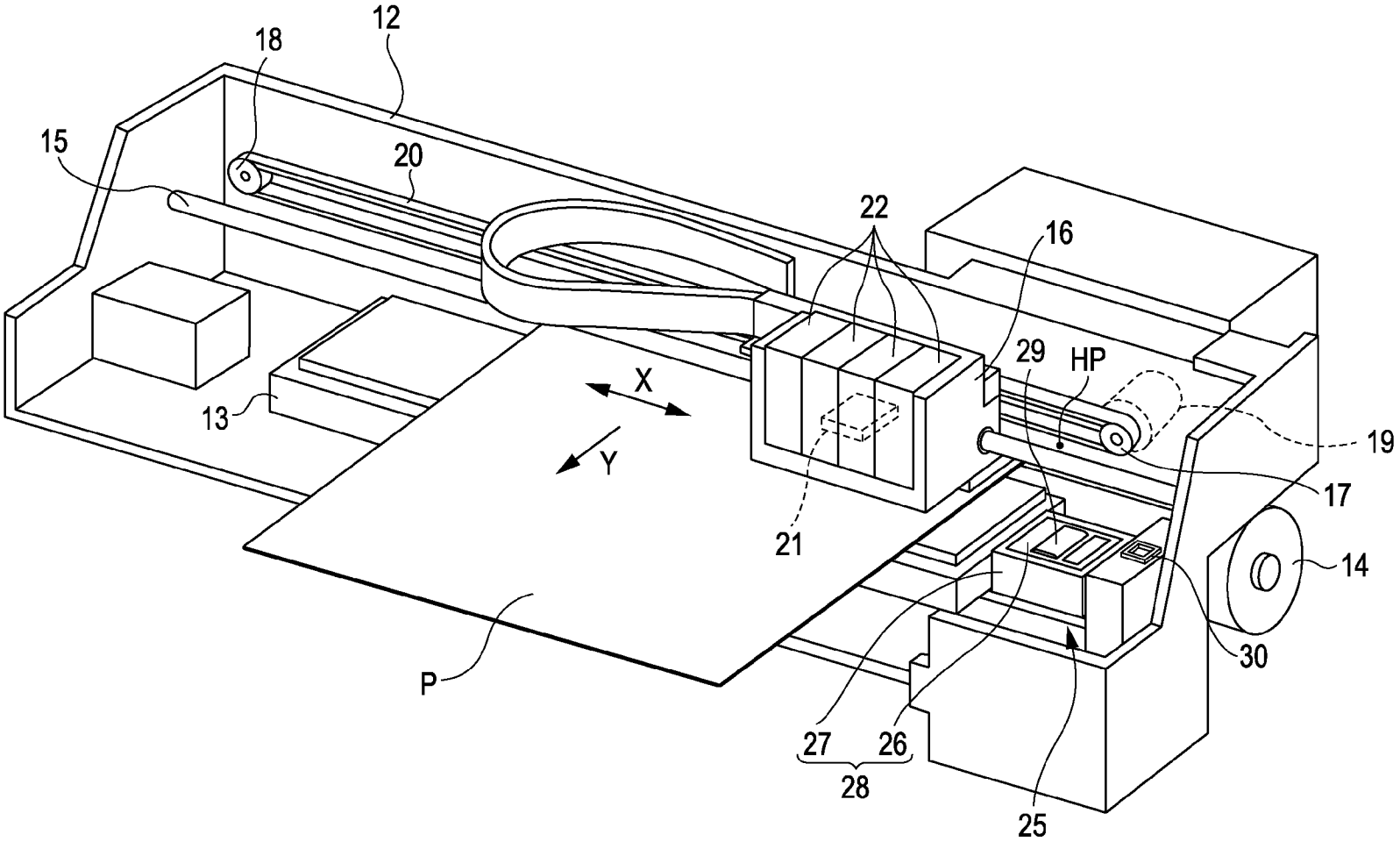
FIG. 7 is a perspective view of the printer of a second embodiment according to the invention.

Now, as illustrated in FIG. 7, the wiper holder 27 is configured to be able to move in the axial direction of the guide shaft 15 which is a moving direction of the carriage 16 according to the driving of the driving mechanism.

Figure 8:
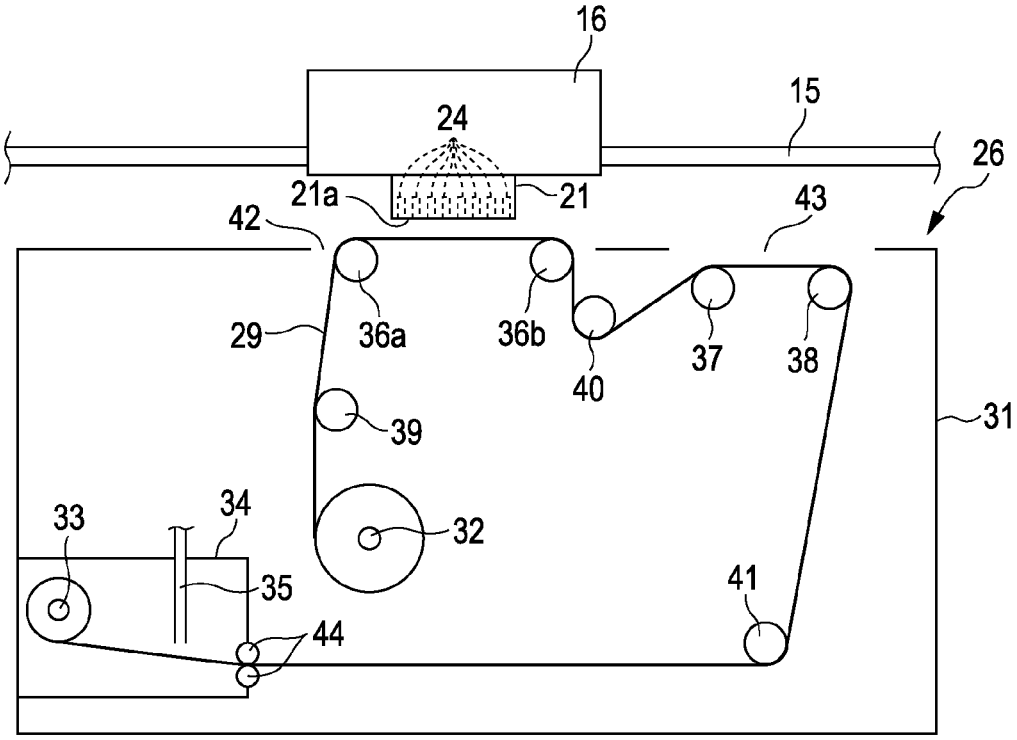
FIG. 8 is a schematic view illustrating an internal configuration of a wiper cassette in the printer of the same embodiment.

Then, as illustrated in FIG. 8, a plurality (seven in the embodiment) of rollers 36*a*, 36*b* and 37 to 41 are provided in the case body 31 of the wiper cassette 26 on the reel-out path of the wiping member 29 between the reel-out roller 32 and the waste-ink tank 34. The rollers 36*a*, 36*b* and 37 to 41 are extended in parallel with the reel-out roller 32 and the winding roller 33.

In particular, a pair of pressing rollers 36*a* and 36*b* are provided above the reel-out roller 32. The pair of the pressing rollers 36*a* and 36*b* are provided to have substantially the same height as each other having a distance in the moving direction of the carriage 16. In addition, an elevation mechanism (not illustrated) is provided at the both ends of the pair of pressing rollers 36*a* and 36*b* in the axial direction. The pair of pressing rollers 36*a* and 36*b* may go up and down in a direction approaching to or separating from the nozzle forming surface 21*a* of the recording head 21 according to the driving of a up and down mechanism.

Figure 9:
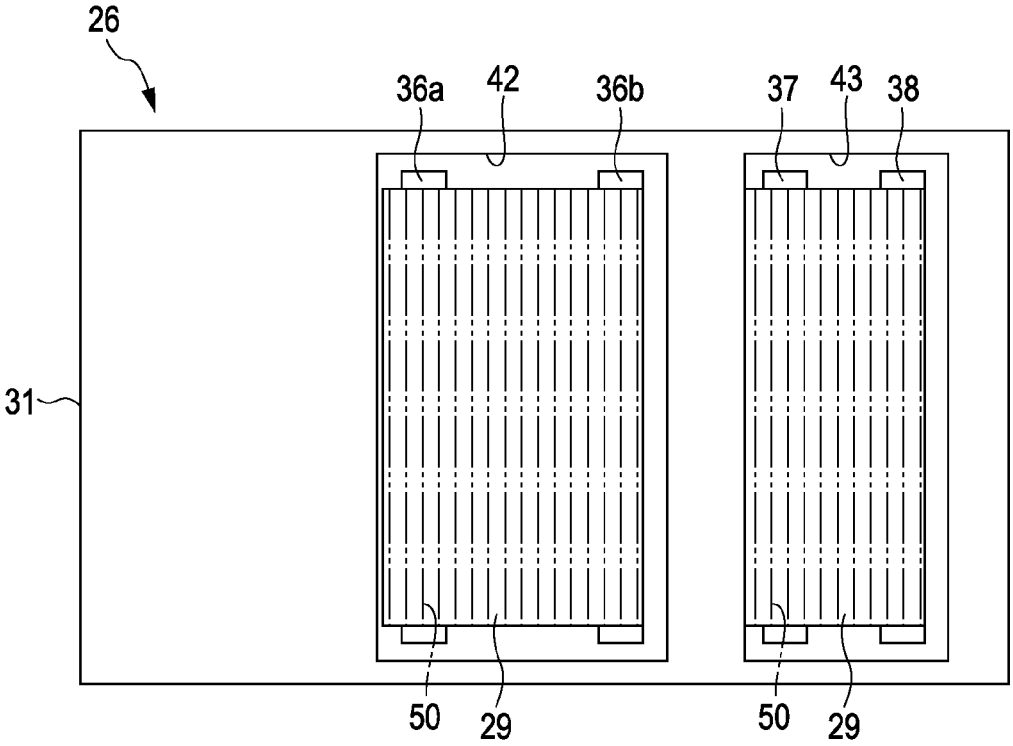
FIG. 9 is a plan view of the wiper cassette in the printer of the same embodiment.
Figure 10:
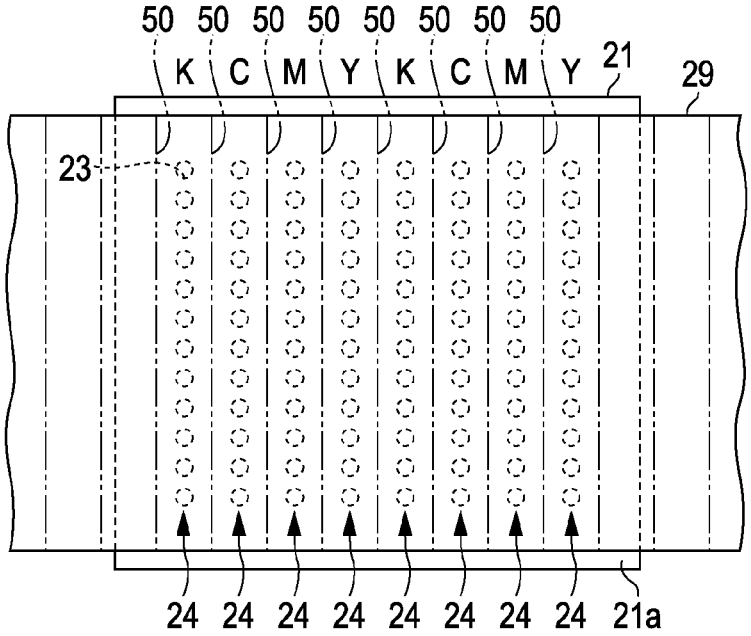
FIG. 10 is a schematic view illustrating a positional relationship between the wiping member and the nozzle row of the recording head in the printer of the same embodiment.

In addition, as illustrated in FIGS. 9 and 10, as through holes illustrated in two-dot chain lines, the entire region of the wiping member 29 in the longitudinal direction has perforations 50 formed so as to extend along the width direction orthogonal to the reel-out direction of the wiping member 29 which is the nozzle row direction of the recording head 21. The perforations 50 are disposed in the same interval in the reel-out direction of the wiping member 29. The interval of the perforations 50 is substantially the same as the interval between the nozzle rows 24 adjacent to each other formed in the nozzle forming surface 21*a* of the recording head 21. Then, when the wiping member 29 abuts the nozzle forming surface 21*a* of the recording head 21, each of the perforations 50 is disposed between the adjacent nozzle rows 24 ejecting different color inks from each other in the direction orthogonal to the nozzle row direction of the recording head 21.

Next, operations of the printer 11 configured as described above will be described.

First, when wiping member 29 wipes the ink from the nozzle forming surface 21*a* of the recording head 21, the carriage 16 is moved to the home position HP. In this case, as illustrated in FIG. 8, in a state where the wiper cassette 26 is disposed in an initial position, the recording head 21 is disposed having a distance vertically with respect to the pressing rollers 36*a* and 36*b*.

Figure 11A:
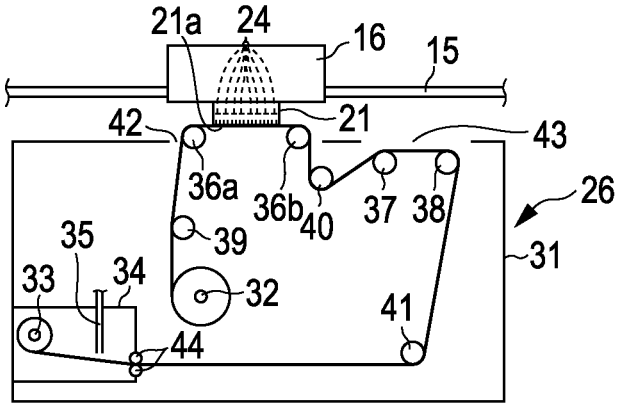
FIGS. 11A to 11C are schematic views illustrating operations when the wiping member removes ink from the nozzle forming surface of the recording head.

Next, as illustrated in FIG. 11A, both the pressing rollers 36*a* and 36*b* are ascended according to the driving of the up and down mechanism. Then, the portion of the wiping member 29 which is hung between the pressing rollers 36*a* and 36*b* absorbs the ink from the nozzle forming surface 21*a* by abutting the nozzle forming surface 21*a* of the recording head 21.

Figure 11B:
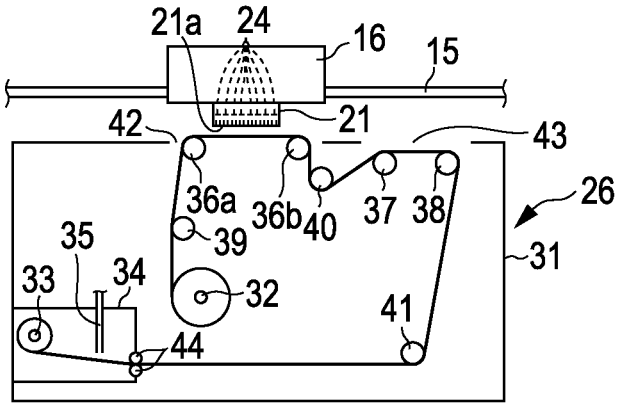

Continuously, as illustrated in FIG. 11B, both the pressing rollers 36*a* and 36*b* are descended according to the driving of the up and down mechanism. Then, the portion of the wiping member 29 which is hung between the pressing rollers 36*a* and 36*b* is separated from the nozzle forming surface 21*a* of the recording head 21.

Figure 12:
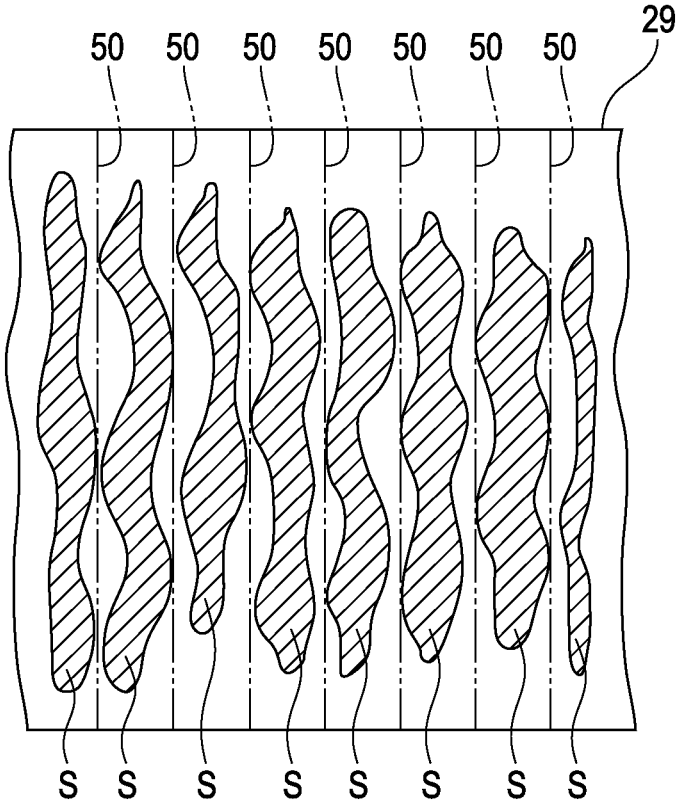
FIG. 12 is a schematic view of the wiping member in which the absorption region of the ink is formed.

In this case, as illustrated in FIG. 12, the absorption region S of the ink, in which each color ink corresponding to each of the nozzle rows 24 of the recording head 21 spreads in the nozzle row direction of the recording head 21 which is the width direction of wiping member 29, is formed on the wiping member 29. Then, the absorption region S of each color ink in the wiping member 29 is separated by the perforations 50 of the wiping member 29 in the reel-out direction of the wiping member 29. As a result, the ink forming the absorption region S penetrates the wiping member 29 in the reel-out direction so as to approach to the adjacent absorption region S, however, this is interrupted by the perforations 50 formed on the wiping member 29.

Then, it is suppressed that the absorption region S of each color ink formed on the wiping member 29 spreads in the reel-out direction of the wiping member 29 and is overlapped with each other. Accordingly, it is suppressed that the inks absorbed in the wiping member 29 are color-mixed with each other. Thus, even though the portion of the wiping member 29 makes a portion, in which the ink is once absorbed, abuts the nozzle forming surface 21*a* of the recording head 21, the absorption region S of the ink in the wiping member 29 comes into contact with the nozzle rows 24 ejecting each corresponding color ink. Accordingly, even though the wiping member 29 abuts repeatedly the nozzle forming surface 21*a* of the recording head 21, it is suppressed that color mixing of the ink occurs in each of the nozzle rows 24 of the recording head 21.

Figure 11C:
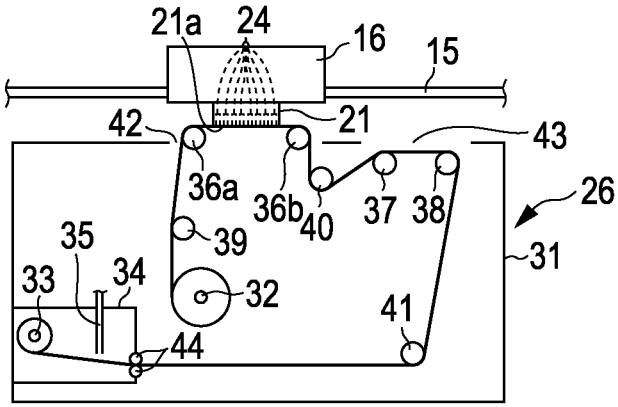

Then, in the embodiment, as illustrated in FIG. 11C, the up and down mechanism is driven without winding up the wiping member 29, and accordingly both of the pressing rollers 36*a* and 36*b* are ascended again. Then, the used portion of the wiping member 29 which is hung between the pressing rollers 36*a* and 36*b* abuts the nozzle forming surface 21*a* of the recording head 21. Then, the ink attached to the nozzle forming surface 21*a* of the recording head 21 is absorbed by the wiping member 29.

According to the second embodiment described above, the same advantages as the advantages (1), (2) and (4) to (11) of the first embodiment described above are obtained.

Each of the embodiments described above may be changed to other embodiments described below.

Figure 13A:
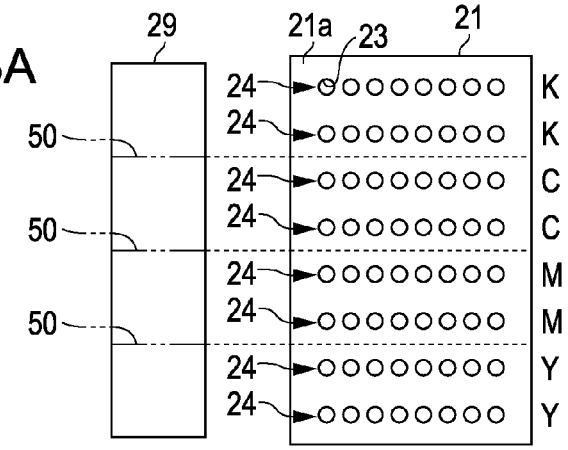
FIGS. 13A to 13C are schematic views illustrating the positional relationship between the wiping member and the nozzle row of the recording head in the printer of other embodiments of the invention.
Figure 13B:
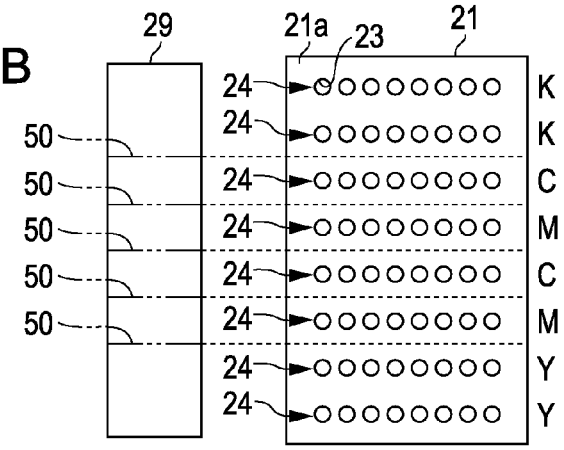

Each of the embodiments described above may have a configuration in which the perforations 50 may be provided in the portion of the wiping member 29 corresponding between the nozzle rows 24 when the ink of the same color is ejected from the adjacent nozzle rows 24, as illustrated in FIGS. 13A and 13B.

Figure 13C:
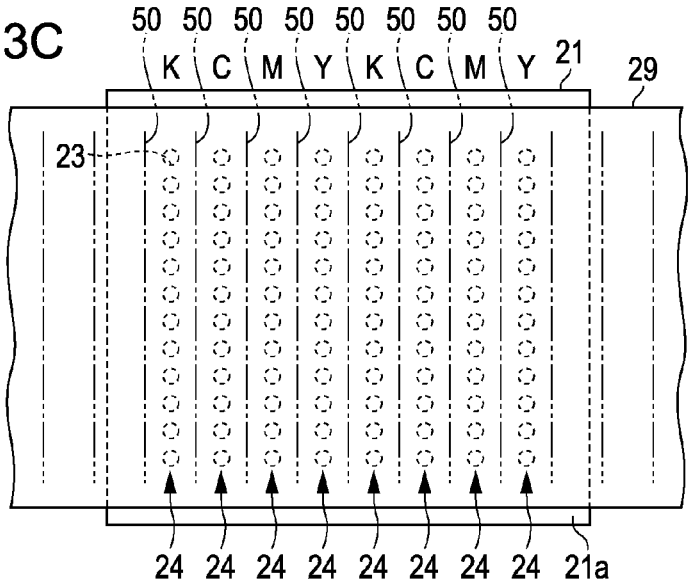

The second embodiment described above may have a configuration in which the perforations 50 are not provided at the both ends of the wiping member 29 in the width direction orthogonal to the reel-out direction, as illustrated in FIG. 13C.

In the configuration, when the tension is acted on the wiping member 29 in the reel-out direction, it is suppressed that the wiping member 29 is broken.

Figure 14A:
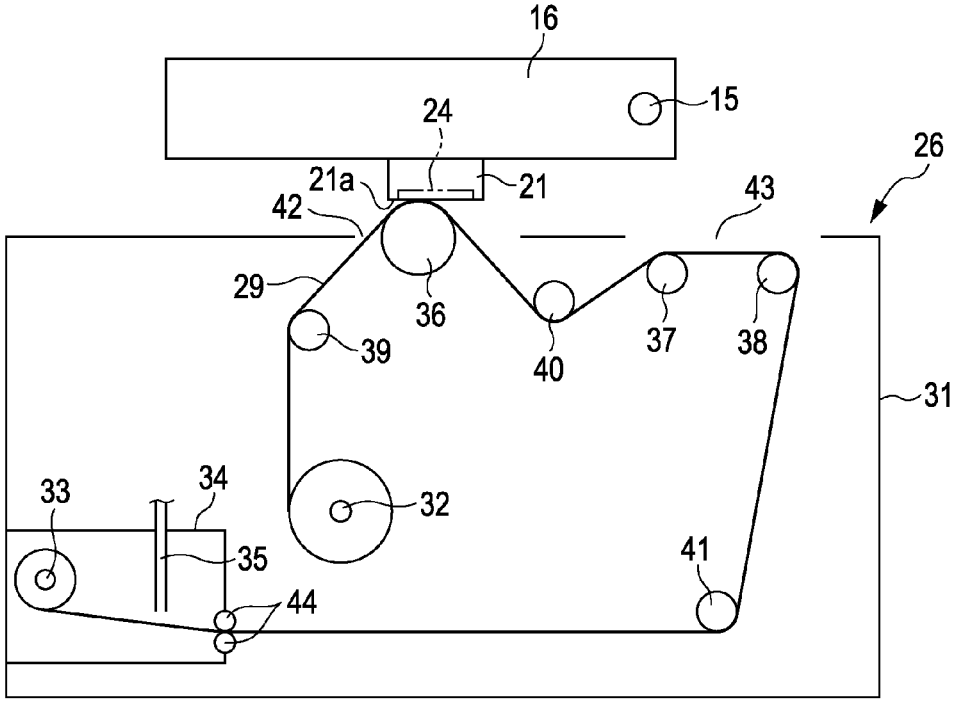
FIGS. 14A and 14B are schematic views illustrating operations when the wiping member removes ink from the nozzle forming surface of the recording head in the printer of other embodiments of the invention.
Figure 14B:
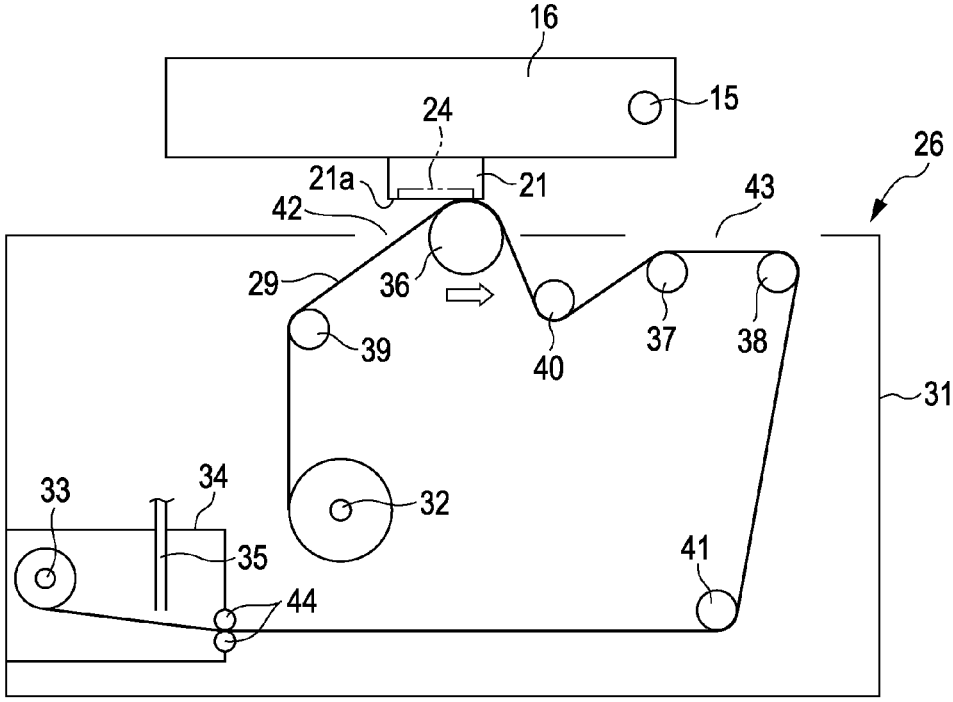

The first embodiment described above may have a configuration in which the pressing roller 36 is moved along the nozzle forming surface 21*a* while the nozzle forming surface 21*a* abuts the portion of the wiping member 29 which is wound and hung on the pressing roller 36, as illustrated in FIGS. 14A and 14B.

The second embodiment described above may have a configuration in which the nozzle forming surface 21*a* of the recording head 21 faces the opening section 43 of the case body 31 in the vertical direction by moving the carriage 16 along the guide shaft 15.

Each of the embodiments described above may have a configuration in which long holes extending in the nozzle row direction of the recording head 21 is provided in the wiping member 29 instead of the perforations 50. In addition, each of the embodiments described above may have a configuration in which it is suppressed that the ink absorbed in the wiping member 29 penetrates and spreads, by carrying out the press process on the wiping member 29 in the thickness direction. In addition, each of the embodiments described above may have a configuration in which it is suppressed that the ink absorbed in the wiping member 29 penetrates and spreads, by impregnating a resin having ink non-absorption characteristics or the like into the wiping member 29.

Each of the embodiments described above may have a configuration in which the wiping member 29 receives the ink idle ejected from the nozzles 23 of the recording head 21 in a surface of the opposite side to the surface which is pressed to the nozzle forming surface 21*a* of the recording head 21 by the pressing roller 36.

Each of the embodiments described above may have a configuration in which the portion of the wiping member 29 which is wound and hung on the pressing roller 36 receives the ink idle ejected from the nozzles 23 of the recording head 21. In this case, the wiping member 29 may receive the ink idle ejected from the nozzles 23 of the recording head 21 in a state of abutting the nozzle forming surface 21*a* of the recording head 21, and the wiping member 29 may receive the ink idle ejected from the nozzles 23 in a state of being separated from the nozzle forming surface 21*a* of the recording head 21.

Each of the embodiments described above may have a configuration in which the winding roller 33 is provided outside the waste-ink tank 34. In other words, an absorption material for receiving the ink discharged from the cap 30 to the waste-ink tank 34 through the discharge tube 35 may be provided in a separate member from the wiping member 29.

Each of the embodiments described above may have a configuration in which an absorption material for receiving the ink idle ejected from the nozzles 23 of the recording head 21 when the flushing operation is performed may be provided in a separate member from the wiping member 29.

In the embodiments described above, the liquid ejecting apparatus is embodied in the ink jet type printer 11, however, the liquid ejecting apparatus may be embodied in a liquid ejecting apparatus ejecting or discharging liquids besides the ink. The embodiment may be applied to various types of liquid ejecting apparatuses including a liquid ejecting head or the like ejecting small amount of liquid droplets. In addition, the liquid droplets are referred to as a state of liquid that are ejected from the liquid ejecting apparatus. The liquid droplets include droplets which trail in a granular shape, a tear shape and a filose shape. In addition, the liquid referred to herein may be a material which can be ejected from the liquid ejecting apparatus. For example, as long as the material is in a state of the liquid phase, the material includes a liquid body having a low or high viscosity, a flow body such as sol, gel water, other inorganic solvent, organic solvent, solution, liquid-like resin and liquid-like metal (metal melt), or not only a liquid as a state of the material, but also particles of the functional material configured of solid materials such as pigment or metal particles which are dissolved, dispersed or mixed in a solvent. In addition, as a representative example of the liquid, the ink described in the above embodiments, liquid crystal or the like is exemplified. Here, the ink includes various types of liquid compositions such as general water-based ink, oil-based ink, gel ink, hot melt ink or the like. Specific examples of the liquid ejecting apparatus are, for example, a liquid crystal display, an electroluminescence (EL) display, a surface emitting display, a liquid ejecting apparatus which ejects a liquid including a material such as an electrode or color material used to produce the color filter in a dispersed or dissolved form. Otherwise, the liquid ejecting apparatus may be a liquid ejecting apparatus ejecting a bioorganic matter used for producing a biochip, a liquid ejecting apparatus ejecting the liquid configured of a sample to be used as a precision pipette, a printing apparatus, micro-dispenser or the like. Furthermore, the liquid ejecting apparatus may be a liquid ejecting apparatus ejecting lubricant at a pin point in a precision machine such as a watch, a camera, or the like, a liquid ejecting apparatus ejecting a transparent resin liquid such as an ultraviolet curing resin to form a small hemispherical lens (an optical lens) which is used in an optical communication element or the like, and a liquid ejecting apparatus ejecting an etching liquid such as acid or alkali to etch a substrate or the like. Then, the invention may be applied to one of these liquid ejecting apparatuses.

The entire disclosure of Japanese Patent Application No. 2012-065875, filed Mar. 22, 2012, is expressly incorporated by reference herein.

What is claimed is:

1. A maintenance device comprising:

a liquid absorption body which absorbs a liquid which is attached to a nozzle forming surface by abutting the nozzle forming surface of a liquid ejecting head in which a plurality of nozzle rows configured of a plurality of nozzles ejecting the liquid are provided in parallel, wherein the liquid absorption body has a penetration suppressing section which suppresses the spread of the liquid due to penetration of the liquid absorbed from the nozzle forming surface of the liquid ejecting head, and wherein the penetration suppressing section is disposed between the nozzle rows ejecting the liquids of different colors from each other in a direction intersecting the nozzle row direction, in a case where the liquid absorption body abuts the nozzle forming surface of the liquid ejecting head, wherein the liquid absorption body is wound after the liquid absorption body abuts the nozzle surface at least two times.

2. The maintenance device according to claim 1, wherein the liquid absorption body wipes the nozzle forming surface by moving in the nozzle row direction in a state of abutting the nozzle forming surface of the liquid ejecting head.

3. A liquid ejecting apparatus comprising:

a plurality of liquid ejecting heads in which nozzle rows configured of a plurality of nozzles are provided in parallel; and the maintenance device according to claim 2.

4. The maintenance device according to claim 1, wherein the penetration suppressing section is a through hole formed on the liquid absorption body.

5. A liquid ejecting apparatus comprising:

a plurality of liquid ejecting heads in which nozzle rows configured of a plurality of nozzles are provided in parallel; and the maintenance device according to claim 4.

6. A liquid ejecting apparatus comprising:

a plurality of liquid ejecting heads in which nozzle rows configured of a plurality of nozzles are provided in parallel; and the maintenance device according to claim 1.

7. The maintenance device according to claim 1, wherein the liquid absorption body is included in a case body, the case body having a first opening and a second opening, the first opening allowing the liquid absorption body to abut the nozzle forming surface to absorb the liquid attached to the nozzle forming surface, the second opening allowing the liquid absorption body to receive liquid which is ejected from the plurality of nozzles during a maintenance rejection, the liquid absorbing surface receiving the liquid during the maintenance rejection without abutting the nozzle surface.

* * * * *